United States Patent [19]

Hutchins

[11] Patent Number: 4,839,995

[45] Date of Patent: Jun. 20, 1989

[54] ABRADING TOOL

[75] Inventor: Alma A. Hutchins, Pasadena, Calif.

[73] Assignee: Hutchins Manufacturing Company, Pasadena, Calif.

[21] Appl. No.: 188,961

[22] Filed: May 2, 1988

[51] Int. Cl.[4] ..... B24B 23/04; B24B 55/06

[52] U.S. Cl. ..... 51/170 MT; 51/273

[58] Field of Search ..... 51/170 MT, 170 TL, 170 R, 51/273

[56] References Cited

U.S. PATENT DOCUMENTS

| | | | |
|---|---|---|---|
| 3,638,362 | 2/1972 | Stoll et al. | 51/170 |
| 3,932,963 | 1/1976 | Hutchins | 51/273 |
| 4,184,291 | 1/1980 | Martin | 51/170 R |
| 4,296,572 | 10/1981 | Quintana | 51/273 |
| 4,671,019 | 6/1987 | Hutchins | 51/170 |
| 4,671,020 | 6/1987 | Hutchins | 51/170 |

OTHER PUBLICATIONS

Advertising Leaflet of Hutchins Manufacturing Company.

Photographs of the Butterfly Valve Element and Aspirator Block.

*Primary Examiner*—Roscoe V. Parker

*Attorney, Agent, or Firm*—William P. Green

[57] ABSTRACT

An abrading tool including a body to be held by a user and carrying a motor which moves a unit relative to the body to abrade a work surface by the action of a sheet of sandpaper or other work abrading element carried by the unit, with the unit containing a passage or passages through which a flow of air and entrained particles abraded from the work surface are drawn by suction, and with the unit carrying a flow control valve which is movable with the unit relative to the body of the tool by the motor and is operable to variably restrict the flow of air and particles by suction through the passage or passages in the unit. The movable unit may include a resiliently deformable cushion through which abrading force is applied to the sandpaper or other abrading element and a backing plate structure more rigid than the cushion and containing a chamber into which air and particles flow from passages in the cushion, with the flow control valve being carried by an upper wall of the backing plate structure.

26 Claims, 4 Drawing Sheets

FIG. 1
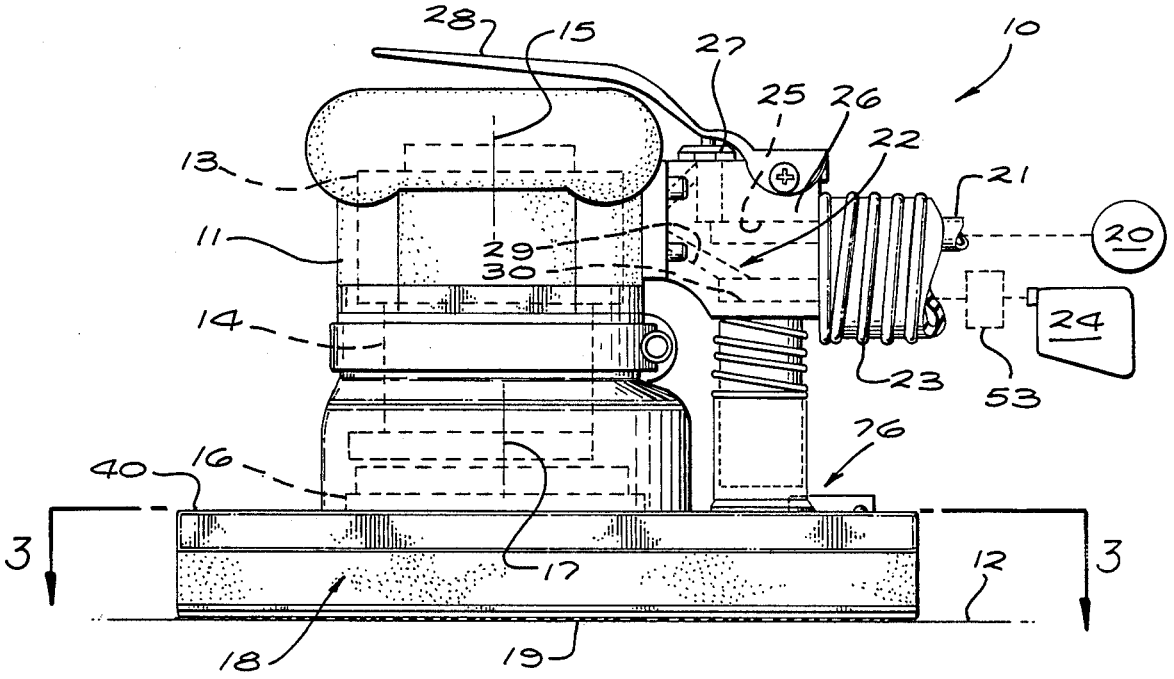
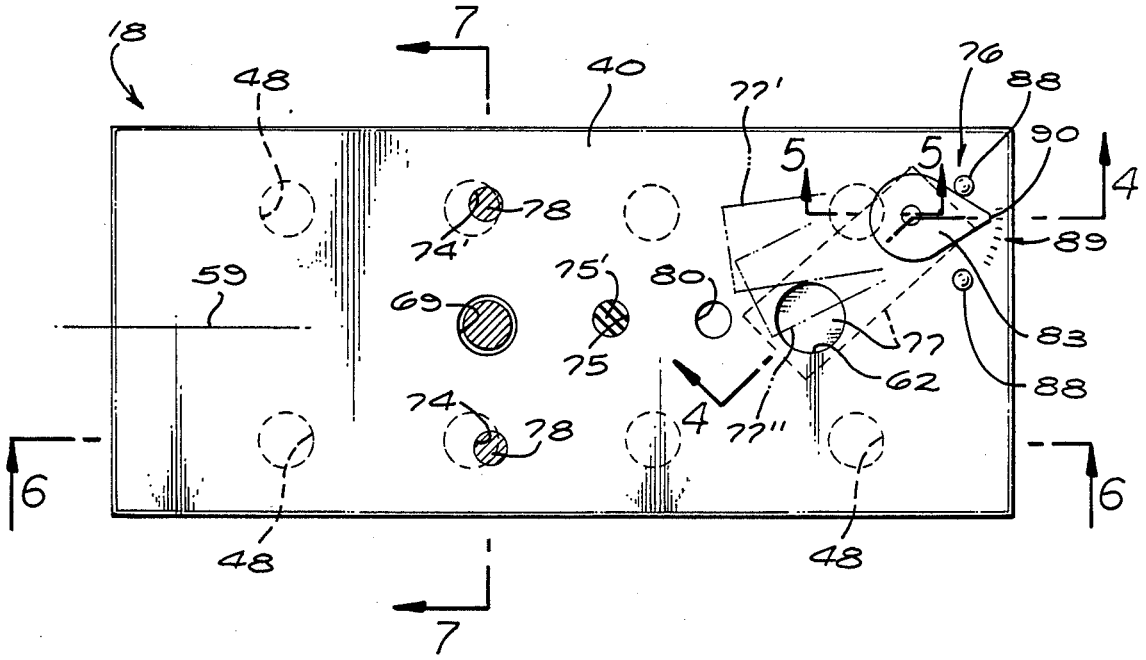
FIG. 3

FIG. 8
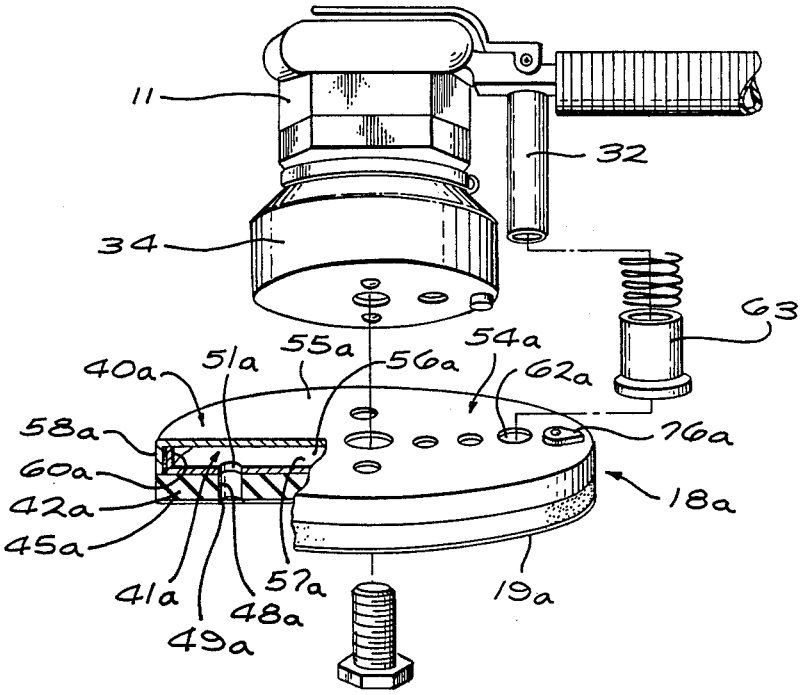
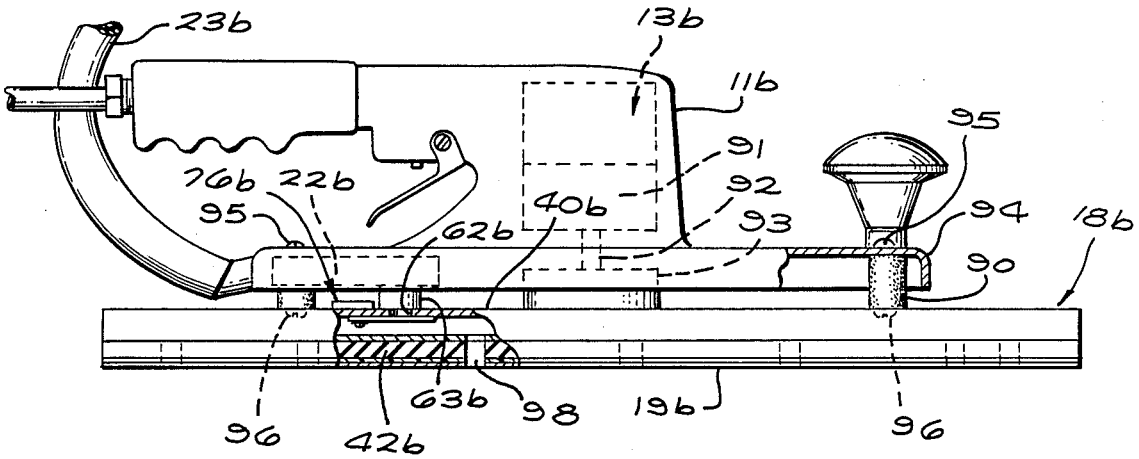
FIG. 9

ABRADING TOOL

BACKGROUND OF THE INVENTION

This invention relates to improved power driven portable sanders or other abrading tools.

The tools of the invention are of a general type including a body to be held and be manipulated by a user, a motor carried by the body, and a sanding pad or other unit mounted to the body for movement relative thereto by the motor to abrade a work surface. The movable unit contains a passage or passages through which a flow of air and particles abraded from the work surface are drawn by suction from a location near that work surface to a collection location. The movable unit may include a resiliently deformable cushion adapted to carry a sheet of sandpaper at its underside, and having a backing plate more rigid than the cushion at the upper side of the cushion.

One problem which has been encountered with tools of this type in the past has resided in their tendency in some instances to develop an excessive amount of suction at the work surface, acting to pull the movable unit and sandpaper too tightly against the work surface and thus restrict the freedom of movement of the tool over that surface and slow the overall sanding operation. An adjustable flow restricting element has been provided in the main body of the tool for regulating the flow of air through the device, but this expedient has proven less effective than would be desired.

SUMMARY OF THE INVENTION

The present invention is concerned with the provision in a tool of the above discussed type of an air flow control valve which is carried directly by the movable abrading unit of the tool, for movement with that unit and the sandpaper or other abrading element relative to the body of the tool. An operator can, by adjustment of the control valve, vary the amount of suction which is applied by the tool to the work surface, and adjust that suction to an amount effectively removing all particles from the work area while at the same time avoiding excessive attraction of the tool to the work surface, with the result that the overall abrading operation can be performed with maximum efficiency and in a minimum of time.

The valve may be accessible for manual actuation by an operator from the exterior of the power actuated unit, and may be carried by a backing plate structure located at the upper side of a deformable cushion. The backing plate structure is preferably hollow and may be formed of two upper and lower members having vertical side walls interfitting with one another in a manner forming a hollow rigid backing plate assembly containing a suction chamber extending over a substantial horizontal extent and communicating with different passages in the cushion therebeneath. The valve may be carried movably by a top wall of the backing plate structure, to variably restrict flow through an opening formed in that top wall and communicating with a conduit carried by the body of the tool.

BRIEF DESCRIPTION OF THE DRAWINGS

The above and other features and objects of the invention will be better understood from the following detailed description of the typical embodiments illustrated in the accompanying drawings in which:

FIG. 1 is a side elevational view of a first form of sander embodying the invention;

FIG. 3 is a horizontal section taken on line 3—3 of FIG. 1, and illustrating the appearance of the upper side of the removable pad of the sander;

FIG. 8 is a somewhat diagrammatic exploded representation of a variational form of sander having a circular rather than rectangular sanding pad; and FIG. 9 is a side view, partially broken away, of another form of saner embodying the invention.

DESCRIPTION OF THE PREFERRED EMBODIMENTS

Figure 2:
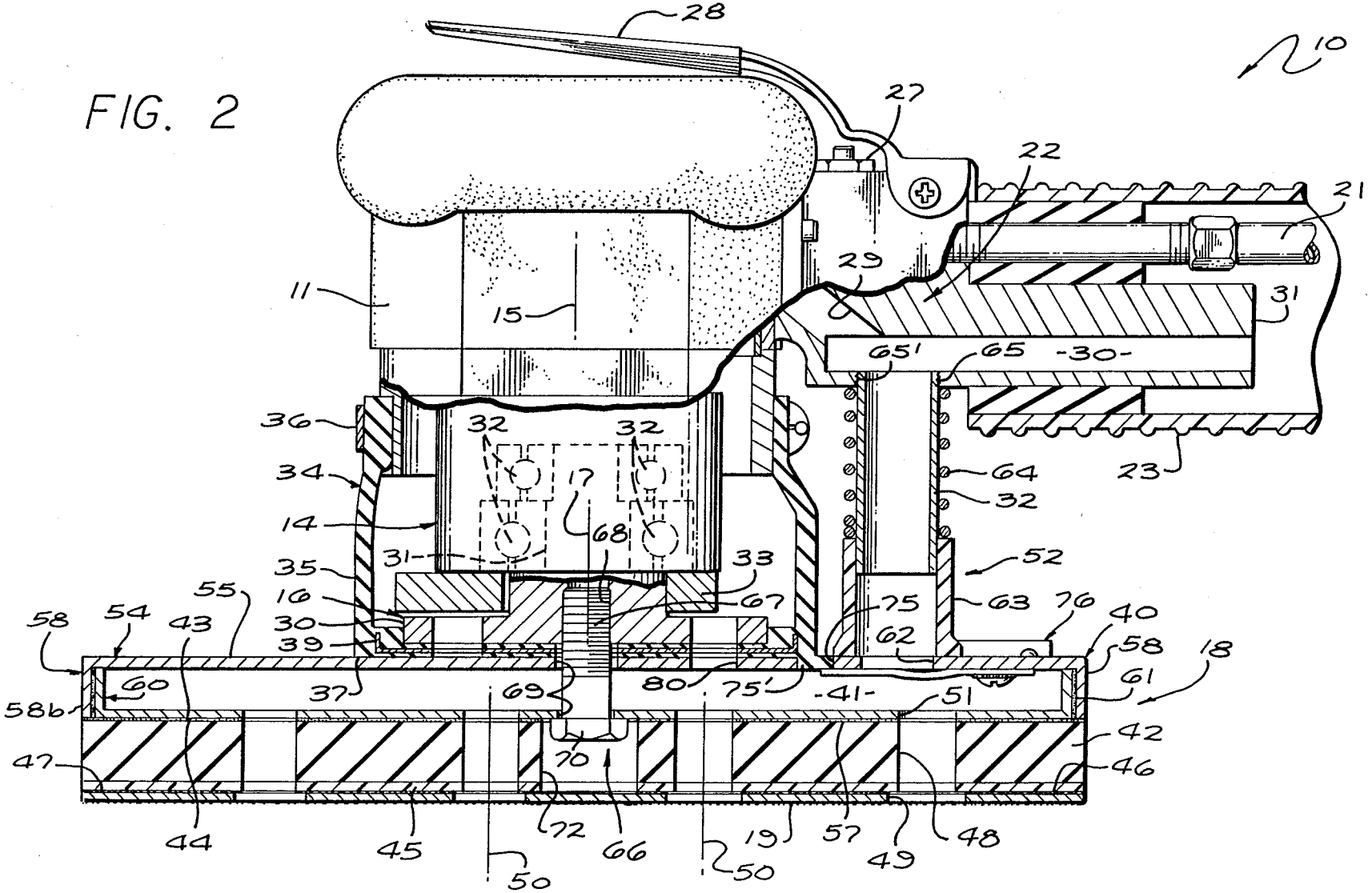
FIG. 2 is an enlarged view of the sander, partially in elevation as in FIG. 1, and with the lower portion illustrated in section.

Referring first to the form of the invention shown in FIGS. 1 through 7, the tool illustrated in those figures is a power driven orbital sander 10 having a body structure 11 shaped externally as a handle to be grasped by a user for holding the tool and moving it along a typically horizontal work surface 12 to sand or polish that surface. An air driven motor 13 contained within the body structure 11 drives a carrier part 14 (FIG. 2) rotatively about a vertical axis 15, with a part 16 being connected to carrier 14 for rotation relative thereto about a second vertical axis 17 offset slightly from and parallel to axis 15, in a relation driving an abrading pad or shoe 18 and a carried sheet of sandpaper 19 orbitally about axis 15 to sand the surface 12. Air is supplied to motor 13 from a source 20 of compressed air through a line 21 connecting into the rear of body structure 11. Exhaust air and particles abraded from the work surface are discharged by an aspirator 22 through a hose 23 leading to a dust collection bag or other container 24. The air delivered to motor 13 flows from inlet line 21 through a passage 25 in a block 26 attached to the handle body 11 of the device, with a valve 27 in the block being actuated manually by a lever 28 to control the delivery of air to the motor in a manner starting and stopping the operation of the sander. Air exhausted from the motor flows through an inclined second passage 29 in block 26, which forms part of the aspirator structure 22. The exhaust air flows from this passage 29 into a horizontally extending passage 30 in block 26, to advance rapidly in a rightward direction as viewed in FIG. 2 through that passage 30 and ultimately discharge at 31 into the interior of hose 23 for flow therethrough to the collection bag 24. The rightwardly flowing air from passage 29 passes generally horizontally across the upper end of a vertical tube 32, to create a vacuum in the upper end of that tube acting to draw air and abraded particles upwardly from the sanding pad 18, for admixture with the main flow of exhaust air from passage 29 and delivery therewith to collection bag 24.

The orbitally driven part 16 may have a lower horizontally extending flange portion 30 which may be circular about the axis 17 of that part. Projecting upwardly from flange 30, part 16 has a shaft portion 31 centered about and extending upwardly along axis 17, and which is journalled within carrier part 14 by bearrings typically represented at 32 to enable the previously mentioned rotation of part 16 relative to part 14 about axis 17. A counterweight 33 may be connected to part 14 to balance the eccentricity of part 16 and the other connected parts with respect to the principle axis 15 of motor 13.

A shroud or boot 34 forms an enclosure about the orbital drive mechanism of the device, and may have an essentially tubular generally vertically extending side wall 35 formed of rubber or other resiliently deformable elastomeric material and secured at its upper end by an annular clamp 36 to a lower portion of the handle body 11 of the tool. At the lower end of side wall 35 of shroud 34, the shroud may have a horizontally extending bottom wall 37 formed of elastomeric material containing a rigid preferably metal reinforcing plate 39 for stiffening of the bottom wall of the device and facillitating its connection to the orbitally moving drive element 16.

The sanding pad or shoe 18 includes a rigid preferably metal backing plate structure 40, which is typically of rectangular horizontal section as seen in FIG. 3, and which is hollow to form within its interior a rectangular air flow chamber 41 from which aspirator 22 takes suction. Beneath the backing plate structure 40, pad 18 includes a cushion 42 of resiliently deformable material through which force is applied to the sandpaper sheet 19 in a manner cushioning contact of the sandpaper with the work surface 12. The cushion 42 is preferably formed of a closed pore foam, desirably polyurethane foam, or the like. The upper horizontal surface 43 of cushion 42 may be bonded to the horizontal undersurface 44 of the more rigid backing plate structure 40. At its underside, cushion 42 may carry a flexible horizontal bottom sheet 45, typically a sheet of fabric backed vinyl material, tightly and permanently bonded to the horizontal undersurface of the cushion. The sandpaper 19 is preferably of a type having a layer of pressure sensitive adhesive 46 on its upper surface 47 adapted to adhere to the horizontal undersurface of bottom sheet 45 of the pad in a manner securing the sandpaper tightly to the pad without the necessity of providing clips or other attaching means for securing the sandpaper. After the sandpaper has been worn to an unusable condition, the sandpaper can easily be stripped from the undersurface of sheet 45 and replaced by a fresh sheet of sandpaper.

Cushion 42 and sheet 45 contain a number of passages 48 communicating at their lower ends with openings 49 formed in the sandpaper, with the passages 48 extending upwardly along individual vertical axes 50 to the upper side of the cushion and at that location communicating through openings 51 in a wall 57 with chamber 41 in the backing plate structure. Thus, when the device is in operation, aspirator 22 creates a flow of air and entrained particles abraded from the work surface upwardly through openings 49 of the sandpaper and passages 48 in the pad and openings 51 to chamber 41, and then through that chamber and a conduit assembly 52 to the aspirator. The air and particles are discharged by the aspirator through hose 23 to collection bag 34. To supplement the action of the aspirator, there may be connected into the suction system a power driven vacuum cleaner mechanism 53 for increasing the suction in the system and enhancing the flow of air and particles toward bag 24.

Figure 7:
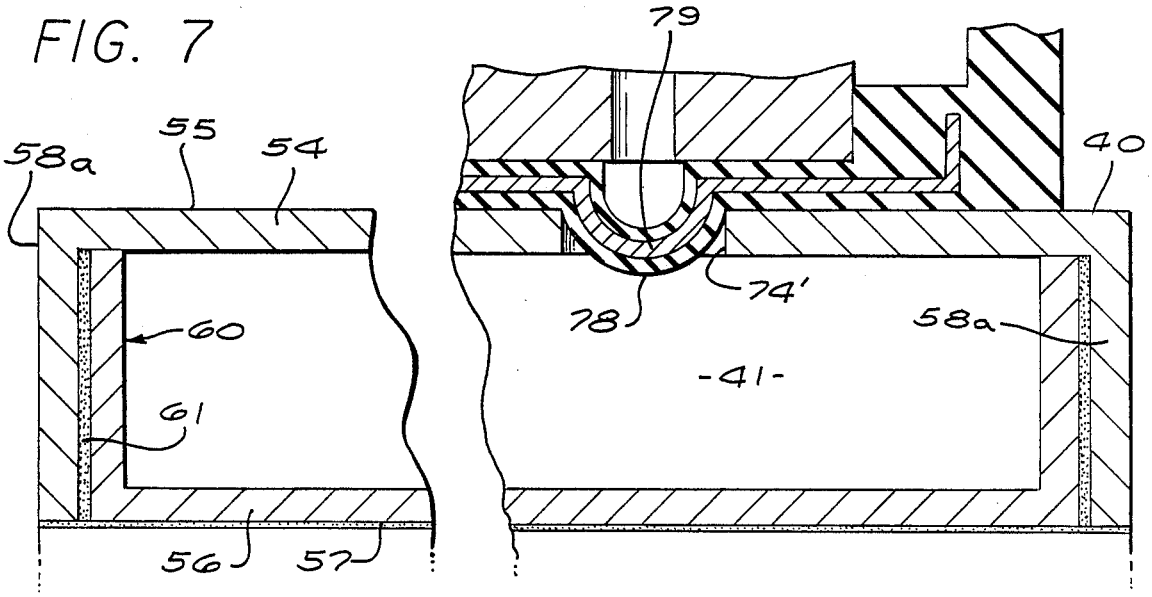
FIG. 7 is an enlarged fragmentary vertical section taken on line 7—7 of FIG. 3.

As seen in FIGS. 2 and 7, the upper backing plate structure 40 of sanding pad 18 is preferably formed as a boxlike assembly including an upper section 54 forming a rectangular horizontal top wall 55 of the hollow box and a lower section 56 forming a rectangular horizontal bottom wall 57 parallel to and spaced beneath top wall 55. Sections 54 and 56 are desirably stamped of sheet metal, typically steel, having sufficient stiffness to permanently maintain its illustrated shape under the forces encountered in a sanding operation. The sheet metal of top section 54 is deformed to provide vertical walls 58 projecting downwardly from top wall 54 along its entire rectangular periphery. More particularly, the walls 58 may include two side walls **58*a* extending parallel to one another and parallel to a main front to rear axis 59 of the tool, and continuing along the entire front to rear extent of the rectangular backing plate structure 40. At the front and rear ends of the pad 18, the walls 58 include parallel front and rear vertical walls 58*b* extending transversely of the pad between the side walls 58*a***.

The bottom section 56 of the backing plate structure 40 is similar to top section 54 but inverted, to have vertical walls 60 projecting upwardly along the entire periphery of the rectangular bottom wall 57 and received at the inner sides of and closely adjacent the corresponding vertical walls 58 of the top section 54. Peripheral rectangularly extending walls 60 of the bottom section project upwardly into engagement with the undersurface of top wall 55 of upper section 54, and the two sections 54 and 56 are then permanently and rigidly bonded together by an appropriate adhesive 61, preferably an epoxy type adhesive. This adhesive may be applied to walls 58 and 60 of the two sections 54 and 60 along their entire lengths about the periphery of the rectangular sections 54 and 56, so that upon curing of the adhesive the two sections 54 and 56 form together a very rigid hollow box structure.

The previously mentioned openings 51 are formed in bottom wall 57 of the hollow backing plate structure 40. Top wall 55 of that backing plate structure contains a number of openings, including an opening 62 through which air and abraded particles are drawn upwardly into conduit assembly 52. That assembly includes the previously mentioned vertical tube 32 projecting downwardly from aspirator block 26 and a second tube 63, which is received about and engages tube 32 telescopically, and which slidably contacts the upper horizontal surface of top wall 55 of the backing plate structure to form a seal about opening 62 confining the flow of air and entrained particles within the interior of the telescopic conduit assembly 2 for delivery to aspirator discharge passage 30. A coil spring 64 disposed about tube 32 bears upwardly against the bottom of block 26 and downwardly against the upper end of tube 63, to yieldingly urge the horizontal bottom surface of tube 63 downwardly against the upper horizontal surface of top wall 55 of backing plate structure 40 to maintain the seal at that location about opening 62. The upper end of tube 32 may be attached to block 26 in any convenient manner, preferably by providing threads 65 on the exterior of the upper end of tube 32 for engaging mating threads formed in the interior of opening 65' in the bottom of block 26 to form a rigid connection therebetween. As will be understood, the internal diameter of the lower end of tube 63 is greater than the diameter of opening 62, and the tube 63 is so positioned relative to opening 62 as to always maintain opening 62 within the lower end of tube 63 as pad 18 moves orbitally relative to tube 63, and thus require flow of all of the air and particles from opening 62 upwardly into tube 63.

Pad 18 is rigidly but detachably secured to the orbitally movable drive element 16 of the tool by a screw or bolt 66, having a threaded shank 67 which is connectable into a correspondingly threaded bore 68 in part 16 centered about axis 17. Shank 67 extends through aligned openings 69 in the top and bottom walls 55 and 57 of backing pate structure 40 of the sanding pad 18, with an enlarged head 70 of screw 66 being tightenable upwardly against wall 57 to apply upward clamping force to the backing plate structure 40. Screw 66 may be insertible upwardly through typically circular openings 72 formed in cushion 42 and bottom sheet 45 of the pad.

In addition to openings 62 and 69 in top wall 55 of the backing plate structure 40, that wall may also contain three openings 74, 75 and 74' into which projections formed on the bottom wall 37 of boot 34 project to maintain pad 18 against rotary movement relative to the boot. The projections on the boot may include a rubber projection 75' (FIG. 2) extending downwardly into opening 75, and two projections 78 (FIGS. 3 and 7) receivable within the two openings 74 and 76. The projections 78 may be formed by providing downwardly projecting dimples 79 in the metal of reinforcing plate 39 and in the rubber coating it as seen in FIG. 7. An additional opening 80 in top wall 55 of backing plate structure 40 may provide communication between the interior of boot 34 and the chamber 41 in the hollow backing pate structure 40, to allow air to be drawn from the interior of the boot into chamber 41 and then to the aspirator.

Figure 4:
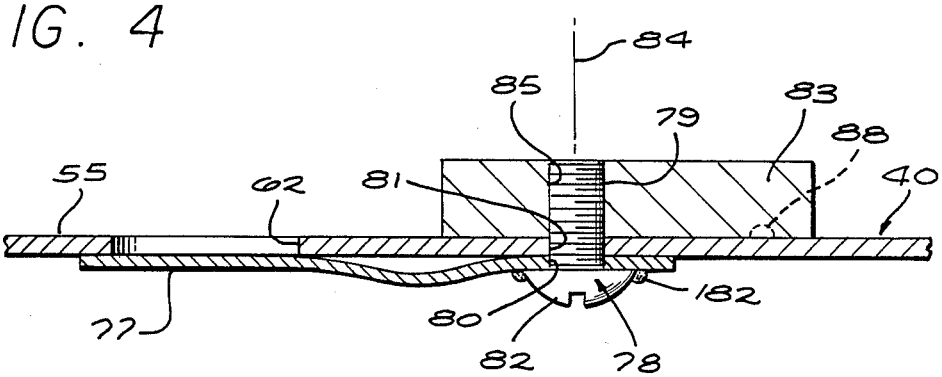
FIG. 4 and 5 are enlarged fragmentary vertical sections taken on lines 4—4 and 5—5 respectively of FIG. 3.
Figure 5:
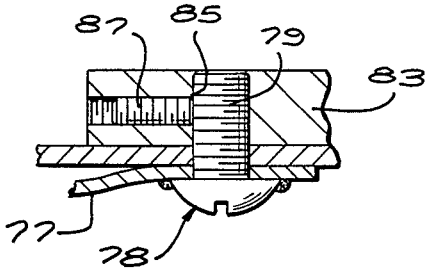
Figure 6:
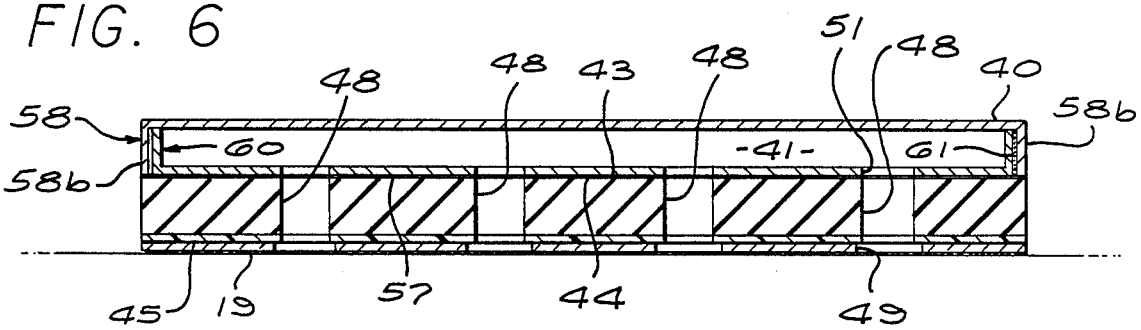
FIG. 6 is a vertical section taken on line 6—6 of FIG. 3.

The present invention is particularly concerned with the provision of a valve 76 for controllably varying the amount of vacuum which is applied to the underside of pad 18 and thus to work surface 12. If that vacuum is excessive, it may tend to cause pad 18 and its carried sandpaper sheet 19 to be attracted too strongly to work surface 12, in a manner resisting movement of the pad along that work surface and thus interfering with an optimum sanding operation. Valve 76 variably restricts the flow of air and particles upwardly through opening 62 and to the aspirator and, in this way controls the suction at the underside of the pad. As seen in FIGS. 4 and 5, valve 76 preferably includes an essentially flat valve element 77 which is located at the underside of top wall 55 of the hollow backing plate structure 40, and is engageable upwardly against the underside of that wall 55 so that in its FIG. 3 closed position element 77 extends entirely across opening 62 and effectively blocks upward movement of any air from chamber 41 in the backing plate structure through opening 62 toward the aspirator. Element 77 is mounted for horizontal swinging movement about a vertical axis 84 between the fully closed position of FIG. 3 and an open position (77' in FIG. 3) in which element 77 is laterally offset from opening 62 and allows unobstructed flow of air through that opening. Between these two positions, element 77 is movable horizontally to an infinite number of intermediate positions (such as position 77'' of FIG. 3) in which it blocks any desired portion of the opening 62, to restrict upward flow of air to any desired extent and thus regulate the amount of vacuum applied to the underside of pad 18 to any desired value.

Element 77 may be mounted for its desired swinging movement by attachment to a screw or bolt 78, having an externally threaded shank 79 projecting upwardly through an opening 80 formed in element 77 and an opening 81 formed in wall 55. An enlarged head 82 of the bolt may bear upwardly against the underside of element 77 about opening 80, and be rigidly secured thereto as by brazing or welding at 182. Above wall 55, an actuating handle 83 is rigidly connected to bolt 79, to be manually actuated about axis 84 for swinging valve element 77 between its open and closed positions. Handle 83 may be attached to bolt 79 by providing handle 83 with a bore 85 into which the upper end of bolt 79 is threadedly connected, and by providing a set screw 87 connected threadedly into handle 83 and tightenable against the bolt.

The swinging movement of handle 83 may be limited by engagement of the handle with two lugs 88 at opposite ends of its range of pivotal movement. Also, markings 89 may be provided on the upper surface of wall 55 for coaction with a pointed end 90 of handle 83 to indicate to a user any of a series of different intermediate positions to which the handle and element 77 may be swung. Element 77 may be formed of spring steel, to be yieldingly urged upwardly by its own resilience into tight engagement with the underside of top wall 55 of backing plate structure 40, at the location of opening 62, and thus assure effective closure of opening 62 in the closed position of the valve element.

In using the device of FIG. 1 through 7, an operator holds the body 11 of the tool and presses downwardly on lever 28 to admit air to motor 13 for causing orbital movement of pad 18 and its carried sandpaper sheet 19 to sand the surface 12 of a workpiece. Air and abraded particles are drawn upwardly through the openings in pad 18 and through the interior of hollow backing plate structure 40 and conduit assembly 52 to aspirator 22 and then through hose 23 to vacuum cleaner 52 and bag 24. If the amount of vacuum provided at the undersurface of the sandpaper is great enough to interfere with free movement of the tool over the work surface 12, or produces vibration of the tool on the work surface by virtue of the excessive vacuum, the operator can adjust valve 76 manually to extend partially across opening 62, in a manner blocking off any desired portion of that opening and thus reducing the vacuum to any desired value. When the action of the tool on the work surface indicates that a proper vacuum setting has been attained, the operator leaves the valve in that condition, and the valve frictionally remains in that set position by virtue of the resilience of the spring steel valve element 77 and the force exerted upwardly by that element against the underside of top wall 55 of the backing plate structure.

FIG. 8 shows a variational arrangement in which a circular sanding pad **18*a* is substituted for the rectangular pad 18 of the first form of the invention. The body 11 of the tool and carried motor, etc. may be the same as in the first form of the invention, including the same boot 34 and suction tubes 32 and 63. Pad 18*a* includes an upper circular hollow rigid backing plate structure 40*a* corresponding to structure 40 of the first form of the invention and containing an opening 62*a* in its upper wall through which air and abraded particles are drawn upwardly into tubes 63 and 32. A circular cushion 42*a* of resiliently deforable material, desirably polyurethane foam, is adhered to the underside of backing plate structure 40*a*, and may carry a flexible sheet of fabric backed vinyl material 45*a* at its underside, to which a circular sheet 19*a* of sanpaper may be adhesively secured. Backing plate structure 40*a* may be formed of an upper circular section 54*a* having a horizontal top wall 55*a* and having a circular downwardly projecting peripheral wall 58*a*, together with a bottom section 56*a* having a circular bottom wall 57*a* with an upwardly projecting circular peripheral wall 60*a* received within peripheral wall 58***a* and bonded rigidly thereto by epoxy cement or the like. Openings 48*a* formed in cushion 42*a* and sheet 45*a* and the communicating openings 51*a* in wall 57*a* of the backing plate structure and openings 49*a* in the sandpaper allow flow of air and abraded particles upwardly by suction to chamber 41*a* in the circular backing plate structure 40*a* and then through tubes 63 and 32 to the aspirator and ultimately to a collection location. A valve 76*a* corresponding to the valve 76 of FIGS. 1 to 7 is provided on the top wall of circular backing plate structure 40*a* of FIG. 8, to variably restrict the flow of air upwardly through opening 62*a* and thus controllably vary the amount of vacuum applied to the work at the underside of the sandpaper sheet. In use, theis valve is adjusted in the same manner described in connection with FIGS. 1 through 7 to attain an optimum condition in which the amount of vacuum is adequate to effectively remove all abraded particles from the work surface and deliver them to a collection bag, while at the same time avoiding the development of excessive vacuum which would interfere with proper movement of the tool along the work surface.

FIG. 9 shows another variational arrangement in which a rectangular pad 18*b* similar to that illustrated in FIGS. 1 to 7 is connected to a handle body ll*b* by four vertical rubber posts 90 rather than by the boot 34 of FIGS. 1 to 7. Handle body 11*b* contains an air motor 13*b* having an orbital drive diagrammatically illustrated at 91 whose output shaft 92 projects downwardly into a bearing 93 attached to the upper side of pad 18*b* to cause orbital movement of that pad in response to energization of motor 13*b*. The handle body 11*b* carries a horizontally extending flange or wall 94 at its lower end to which the upper ends of posts 90 are attached by fasteners represented at 95. The lower ends of the posts are similarly attached by screws 96 to pad 18*b*.

The pad 18*b* has an upper box-like hollow backing plate structure 40*b* corresponding to structure 40 of the first form of the invention, and carrying a cushion 42*b*, vinyl sheet 45*b* and sandpaper sheet 19*b*, all containing openings 98 through which air and particles are drawn upwardly to the interior of the hollow backing plate structure. A tubs 63*b* corresponding to tube 63 of the first form of the invention is spring urged downwardly against the top wall of backing plate structure 40*b* about an opening 62*b*, and conducts air and particles to an aspirator 22*b* carried by body 11*b* and corresponding to aspirator 22 of the first form of the invention, to draw air upwardly from the interior of the backing plate structure through tube 63*b* and the aspirator and connected hose 23*b* to a collection location. A valve 76*b* corresponding to valve 76 of the first of the invention is manually adjustable to variably restrict the amount of air which can flow upwardly through opening 62*b* in the top wall of backing plate structure 40*b*, to thus control the amount of vacuum applied to the work surface at the underside of the sandpaper, and thereby attain the advantages discussed in connection with the other forms of the invention.

While certain specific embodiments of the present invention have been disclosed as typical, the invention is of course not limited to these particular forms, but rather is applicable broadly to all such variations as fall within the scope of the appended claims.

I claim:

1. An abrading tool comprising:

a body to be held by a user;

a unit mounted to said body for movement relative thereto and adapted to carry a work abrading element;

a motor carried by said body and operable to move said unit relative to the body to abrade a work surface;

said unit containing a passage or passages through which a flow of air and entrained particles abraded from the work surface are drawn by suction; and a flow control valve carried by said unit and movable with said unit and a carried abrading element relative to said body by said motor;

said valve being operable to vary the effective size of an opening through which said air and entrained particles are drawn by suction, to thereby variably restrict the flow of air and particles through said opening and through said passage or passages in said unit.

2. An abrading tool as recited in claim 1, in which said unit includes a deformable cushion through which abrading force is applied to said abrading element, and a backing plate structure more rigid than said cushion and which carries said flow control valve for movement with said cushion and backing plate structure relative to said body by said motor.

3. An abrading tool comprising:

a body to be held by a user;

a unit mounted to said body for movement relative thereto and adapted to carry a work abrading element;

a motor carried by said body and operable to move said unit relative to the body to abrade a work surface;

said unit containing a passage or passages through which a flow of air and entrained particles abraded from the work surface are drawn by suction; and a flow control valve carried by said unit and movable with said unit relative to said body by said motor and operable to variably restrict the flow of air and particles by suction through said passage or passages in said unit;

said unit including a deformable cushion through which abrading force is applied to said element, and a hollow backing plate structure at an upper side of said cushion;

said passage or passages including a plurality of passages in said cushion and a chamber formed within the interior of said backing plate structure and through which air and entrained particles flow from said passages in the cushion to an outlet opening formed in said backing plate structure;

said flow control valve comprising a valve element carried by said backing plate structure and movable across said opening to variably restrict the flow of air and particles therethrough.

4. An abrading tool comprising:

a body to be held by a user;

a unit mounted to said body for movement relative thereto and adapted to carry a work abrading element;

a motor carried by said body and operable to move said unit relative to the body to abrade a work surface;

said unit containing a passage or passages through which a flow of air and entrained particles abraded from the work surface are drawn by suction; and a flow control valve carried by said unit and movable with said unit relative to said body by said motor and operable to variably restrict the flow of air and particles by suction through said passage or passages in said unit;

said unit including a backing plate structure having a top wall with an opening through which said flow of air and abraded particles are drawn by suction;

said flow control valve including a valev element at the underside of said top wall and connected to said wall for dorizontal swinging movement relative thereto to positions extending different distances across the opening and thereby variably restricting the flow of air and particles through the opening.

5. An abrading tool as recited in claim 4, including a valve operating member carried by said top wall at the upper side thereof and connected to said valve element and manually actuable to swing said valve element horizontally relative to said top wall to vary the flow through said opening.

6. An abrading tool comprising:

a body to be held by a user;

a unit mounted to said body for movement relative thereto and adapted to carry a work abrading element;

a motor carried by said body and operable to move said unit relative to the body to abrade a work surface;

said unit containing a passage or passages through which a flow of air and entrained particles abraded from the work surface are drawn by suction; and a flow control valve carried by said unit and movable with said unit relative to said body by said motor and operable to variably restrict the flow of air and particles by suction through said passage or passages in said unit;

said unit including a deformable cushion through which abrading force is applied to said element, and a backing plate sturcture at an upper side of said cushion movable with the cushion by said motor relative to said body;

said backing plate structure including an upper member having a horizontally extending top wall and having downwardly projecting side walls extending along the periphery of said top wall, and a lower member having a horizontally extending bottom wall spaced beneath said top wall of said upper member and carrying upwardly projecting said walls extending along the periphery of said bottom wall;

said side walls of one of said upper and lower members being received within and closely adjacent said side walls of the other of said upper and lower members.

7. An abrading tool as recited in claim 6, in which said top wall of said upper member contains an opening through which air and abraded particles are drawn by suction, said flow control valve being carried by said top wall of said upper member and adapted to variably restrict flow through said opening.

8. An abrading tool as recited in claim 6, including bonding material attaching said side walls of said upper member to said side walls of said lower member.

9. An abrading tool comprising:

a body to be held by a user;

a unit mounted to said body for movement relative thereto and adapted to carry a work abrading element;

a motor carried by said body and operable to move said unit relative to the body to abrade a work surface;

said unit containing a passage or passages through which a flow of air and entrained particles abraded from the work surface are drawn by suction;

a flow control valve carried by said unit and movable with said unit relative to said body by said motor and operable to variably restrict the flow of air and particles by suction through said passage or passages in said unit;

said unit including a resiliently deformable cushion and an upper backing plate structure carrying and more rigid than said cushion and having a top wall containing an opening through which said air and abraded particles flow upwardly from said unit;

a conduit projecting downwardly from said body and slidably engaging said top wall about said opening to receive air and abraded particles from the opening;

said flow control valve including a valve element carried by said top wall and adapted to extend different distances across said opening to variably restrict the flow of air and particles therethrough; and a manually actuable operating element accessible from the exterior of said backing plate structure for manually opening and closing said valve element.

10. An abrading tool comprising:

a body to be held by a user;

a unit mounted to said body for movement relative thereto and adapted to carry a work abrading element;

a motor carried by said body and operable to move said unit relative to the body to abrade a work surface;

said unit including a deformable cushion through which abrading force is applied to said element, and a backing plate structure at an upper side of and more rigid than said cushion;

said backing plate structure including an upper member having a horizontally extending top wall and side walls projecting downwardly from the periphery of said top wall, and including a lower member having a horizontally extending bottom wall spaced beneath said top wall of said upper member and having upwardly projecting side walls extending along the periphery of said bottom wall, said side walls of one of said upper and lower members being received within and closely adjacent said side walls of the other of said upper and lower members.

11. An abrading tool as recited in claim 10, including means bonding said side walls of said upper member of the backing plate structure to said side walls of said lower member of said backing plate structure.

12. An abrading tool as recited in claim 10, in which said cushion contains one or more passages for conducting a flow of air and abraded particles upwardly to the interior of said backing plate structure between said upper and lower members thereof, one of said upper and lower members containing an opening through which said flow of air and abraded particles is drawn by suction.

13. An abrading tool as recited in claim 10, in which said cushion contains a passage or passages for leading air and abraded particles to the interior of said backing plate structure between said upper and lower members, said top wall of said upper member of the backing plate structure containing an upwardly facing opening for conducting air and abraded particles upwardly from the interior of the backing plate structure, there being a conduit carried by said body and communicating with said opening for withdrawing air and abraded particles by suction from the backing plate structure, and a flow control valve carried movably by said top wall of said upper member of the backing plate structure and manually actuable from the exterior of said backing plate structure to variably restrict the flow of air and particles through said opening.

14. For use with a portable abrading tool having a body to be held by a user and carrying a motor, the combination comprising:

a unit adapted to be mounted to said body for movement relative thereto by said motor and adapted to carry an abrading element for abrading a work surface upon powered movement of the unit and abrading element relative to said body;

said unit containing a passage or passages through which a flow of air and entrained particles abraded from the work surface are drawn by suction; and a flow control valve carried by said unit and movable with said unit and a carried abrading element relative to said body by said motor;

said valve being operable to vary the effective size of an opening through which said air and entrained particles are drawn by suction, to thereby variably restrict the flow of air and particles through said opening and through said passage or passages in said unit.

15. The combination as recited in claim 14, in which said unit includes a deformable cushion through which abrading force is applied to said abrading element, and a backing plate structure more rigid than said cushion and which carries said flow control valve for movement with said cushion and backing plate structure relative to said body by said motor.

16. For use with a portable abrading tool having a body to be held by a user and carrying a motor, the combination comprising:

a unit adapted to be mounted to said body for movement relative thereto by said motor and adapted to carry an abrading element for abrading a work surface upon powered movement of the unit and abrading element relative to said body;

said unit containing a passage or passages through which a flow of air and entrained particles abraded from the work surface are drawn by suction; and a flow control valve carried by said unit and movable with said unit relative to said body by said motor and operable to variably restrict the flow of air and particles by suction through said passage or passages in said unit;

said unit including a deformable cushion through which abrading force is applied to said element, and a hollow backing plate structure at an upper said of said cushion;

said passage or passages including a plurality of passages in said cushion and a chamber formed within the interior of said backing plate structure and through which air and entrained particles flow from said passages in the cushion to an outlet opening formed in said backing plate structure;

said flow control valve comprising a valve element carried by said backing plate structure and movable across said opening to variably restrict the flow of air and particles therethrough.

17. For use with a portable abrading tool having a body to be held by a user and carrying a motor, the combination comprising:

a unit adapted to be mounted to said body for movement relative thereto by said motor and adapted to carry an abrading element for abrading a work surface upon powered movement of the unit and abrading element relative to said body;

said unit containing a passage or passages through which a flow of air and entrained particles abraded from the work surface are drawn by suction; and a flow control valve carried by said unit and movable with said unit relative to said body by said motor and operable to variably restrict the flow of air and particles by suction through said passage or passages in said unit;

said unit including a backing plate structure having a top wall with an opening through which said flow of air and abraded particles are drawn by suction;

said flow control valve including a valve element at the underside of said top wall and connected to said wall for horizontal swinging movement relative thereto to positions extending different distances across the opening and thereby variably restricting the flow of air and particles through the opening.

18. The combination as recited in claim 17, including a valve operating member carried by said top wall at the upper side thereof and connected to said valve element and manually actuable to swing said valve element horizontally relative to said top wall to vary the flow through said opening.

19. For use with a portable abrading tool having a body to be held by a user and carrying a motor, the combination comprising:

a unit adapted to be mounted to said body for movement relative thereto by said motor and adapted to carry an abrading element for abrading a work surface upon powered movement of the unit and abrading element relative to said body;

said unit containing a passage or passages through which a flow of air and entrained particles abraded from the work surface are drawn by suction; and a flow control valve carried by said unit and movable with said unit relative to said body by said motor and operable to variably restrict the flow of air and particles by suction through said passage or passages in said unit;

said unit including a deformable cushion through which abrading force is applied to said element, and a backing plate structure at an upper side of said cushion movable with the cushion by said motor relative to said body;

said backing plate structure including an upper member having a horizontally extending top wall and having downwardly projecting side walls extending along the periphery of said top wall, and a lower member having a horizontally extending bottom wall spaced beneath said top wall of said upper member and carrying upwardly projecting side walls extending along the periphery of said bottom wall;

said side walls of one of said upper and lower members being received within and closely adjacent said side walls of the other of said upper and lower members.

20. The combination as recited in claim 19, in which said top wall of said upper member cintains an opening through which air and abraded particles are drawn by suction, said flow control valve being carried by said top wall of said upper member and adapted to variable restrict flow through said opening.

21. The combination as recited in claim 19, including bonding material attaching said side walls of said upper member to said side walls of said lower member.

22. For use with a portable abrading tool having a body to be held by a user and carrying a motor, the combination comprising:

a unit adapted to be mounted to said body for movement reative thereto by said motor and adapted to carry an abrading element for abrading a work surface upon powered movement of the unit and abrading element relative to said body;

said unit containing a passage or passages through which a flow of air and entrained particles abraded from the work surface are drawn by suction;

a flow control valve carried by said unit and movable with said unit relative to said body by said motor and operable to variably restrict the flow of air and particles by suction through said passage or passages in said unit;

said unit including a resiliently deformable cushion and an upper backing plate structure carrying and more rigid than said cushion and having a top wall containing an opening through which said air and abraded particles flow upwardly from said unit;

a conduit projecting downwardly from said body and slidably engaging said top wall about said opening to receive air and abraded particles from the opening;

said flow control valve including a valve element carried by said top wall and adapted to extend different distances across said opening to variably restrict the flow of air and particles therethrough; and a manually actuable operating element accessible from the exterior of said backing plate structure for manually opening and closing said valve element.

23. For use with a portable abrading tool having a body to be held by a user and carrying a motor, the combination comprising:

a unit adapted to be mounted to said body for movement relative thereto by said motor and adapted to carry an abrading element for abrading a work surface upon powered movement of the unit and abrading element relative to said body;

said unit including a deformable cushion through which abrading force is applied to said element, and a backing plate structure at an upper side of and more rigid than said cushion;

said backing plate structure including an upper member having a horizontally extending top wall and side walls projecting downwardly from the periphery of said top wall, and including a lower member having a horizontally extending bottom wall spaced beneath said top wall of said upper member and having upwardly projecting side walls extending along the periphery of said bottom wall, said side walls of one of said upper and lower members being received within and closely adjacent said side walls of the other of said upper and lower members.

24. The combination as recited in claim 23, including means bonding said side walls of said upper member of the backing plate structure to said walls of said lower member of said backing plate structure.

25. The combination as recited in claim 23, in which said cushion contains one or more passages for conducting a flow of air and abraded particles upwardly to the interior of said backing plate structure between said upper and lower members thereof, one of said upper and lower members containing an opening through which said flow of air and abraded particles is drawn by suction.

26. The combination as recited in claim 23, in which said cushion contains a passage or passages for leading air and abraded particles to the interior of said backing plate structure between said upper and lower members, said top wall of said upper member of the backing plate structure containing an upwardly facing opening for conducting air and abraded particles upwardly from the interior of the backing plate structure, there being a conduit carried by said body and communicating with said opening for withdrawing air and abraded particles by suction from the backing plate structure, and a flow control valve carried movably by said top wall of said upper member of the backing plate structure and manually actuable from the exterior of said backing plate structure to variably restrict the flow of air and particles through said opening.

* * * * *